US007614514B2

(12) United States Patent
Fuchs

(10) Patent No.: US 7,614,514 B2
(45) Date of Patent: Nov. 10, 2009

(54) TAMPER EVIDENT TUBE CLOSURE WITH TWIST-AWAY CENTERING

(75) Inventor: Peter Fuchs, Steffisburg (CH)

(73) Assignee: Hoffmann Neopac AG, Thun (CH)

( * ) Notice: Subject to any disclaimer, the term of this patent is extended or adjusted under 35 U.S.C. 154(b) by 363 days.

(21) Appl. No.: 10/532,943

(22) PCT Filed: Nov. 13, 2002

(86) PCT No.: PCT/IB02/04772

§ 371 (c)(1),
(2), (4) Date: Dec. 13, 2005

(87) PCT Pub. No.: WO2004/043816

PCT Pub. Date: May 27, 2004

(65) Prior Publication Data

US 2006/0151417 A1 Jul. 13, 2006

(51) Int. Cl.

| | |
|---|---|
| ***B65D 39/00*** | (2006.01) |
| ***B65D 51/24*** | (2006.01) |
| ***B65D 1/02*** | (2006.01) |
| ***B65D 17/36*** | (2006.01) |
| ***B65D 47/10*** | (2006.01) |

(52) U.S. Cl. ..... 215/256; 215/302; 215/48; 220/274; 222/541.8

(58) Field of Classification Search ..... 215/48, 215/302, 256, 295; 220/274, 278, 276; 222/541.5, 222/541.8, 92

See application file for complete search history.

(56) References Cited

U.S. PATENT DOCUMENTS

| | | | | |
|---|---|---|---|---|
| 2,317,420 | A * | 4/1943 | Taylor | 220/265 |
| 4,134,511 | A * | 1/1979 | Deussen | 215/48 |
| 4,608,285 | A * | 8/1986 | Tavss et al. | 222/92 |
| 4,666,063 | A * | 5/1987 | Holoubek et al. | 222/107 |
| 4,688,703 | A | 8/1987 | Bayer | |
| 4,773,548 | A | 9/1988 | Deussen | |
| 5,255,804 | A | 10/1993 | Butterbrodt | |
| 5,586,672 | A | 12/1996 | Schneider et al. | |

* cited by examiner

*Primary Examiner*—Robin Hylton
(74) *Attorney, Agent, or Firm*—Marshall, Gerstein & Borun LLP

(57) ABSTRACT

Disclosed herein is a tamper evident closure for a container having a cap on a spout. The inverted cap can be used as a tool for removing a twist away element. Both, the cap and the spout have conic guiding surfaces, which center the cap in respect to the spout, while it is removed towards and onto the spout. The initial opening of the tamper evident closure is therefore easier.

17 Claims, 5 Drawing Sheets

TAMPER EVIDENT TUBE CLOSURE WITH TWIST-AWAY CENTERING

RELATED APPLICATIONS

This application is the U.S. National Phase Application pursuant to 35 U.S.C. § 371 of International Patent Application Ser. No. PCT/IB2002/004772 filed Nov. 13, 2003. The entire disclosure of the foregoing application is incorporated herein by reference in its entirety.

TECHNICAL FIELD

The invention relates to a closure.

Closures of this kind, as described in U.S. Pat. No. 4,688,703, are used for tamper evident containers containing liquids, pastes or other products, in particular pharmaceutical, dental or cosmetic products. The basic principle of these closures is, that the cap is used as a tool for opening the container, in particular by twisting away a twist away element on a spout and thereby creating an opening.

BACKGROUND ART

Known closures of this kind are usually not easy to use. This can be an advantage, because it can make the container child-safe, as described in U.S. Pat. No. 4,688,703. However, many times the users of products delivered in such containers are elderly persons, in particular with bad cognitive and motoric skills, which cannot perform a difficult opening procedure.

DISCLOSURE OF INVENTION

A problem to be solved by the present invention lies therefore in providing a tamper evident closure of the kind mentioned at the outset, which is easier to use than known tamper evident closures.

This problem is solved by providing a centering aid, which centers the cap, while it is moved towards and onto the spout for removing the twist away element.

BRIEF DESCRIPTION OF DRAWINGS

Further preferred features and aspects of the present invention are described in the dependent claims as well as in the following description, which makes reference to the enclosed figures. These figures show:

BEST MODE FOR CARRYING OUT THE INVENTION

Figure 1:
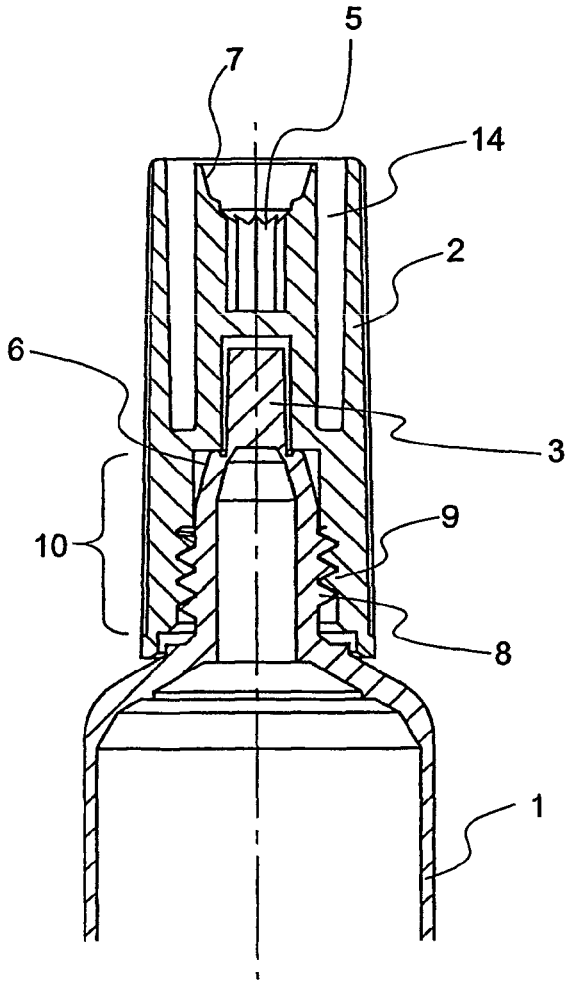
FIG. 1 a sectional view of a container with a closure according to the invention, in a sealed state, FIG. 2 a sectional view of the container of FIG. 1, in the sealed state, but after removing the cap, FIG. 3 a sectional view of the container of FIGS. 1 and 2 with the cap while being used as a tool for removing the twist away element, FIG. 4 a sectional view of the container of FIG. 1 to 3 after the twist away element was removed, FIG. 5 a three dimensional view of a container with a closure according to the invention, FIG. 6 a three dimensional view of a container with a closure according to the invention with a spout designed as a cannula.
Figure 7:
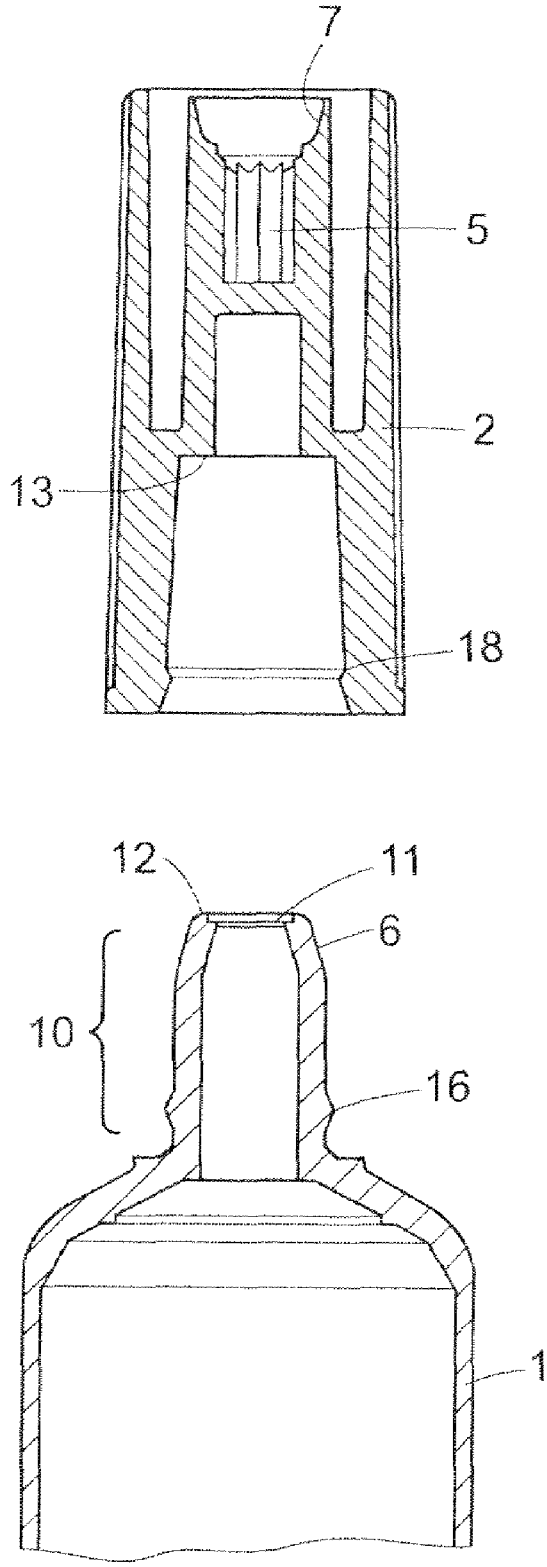
FIG. 7 is a sectional view if a container with a closure according to the invention with a snap on means for holding the cap on the container.

A sectional view of a container 1 with a preferred embodiment of the closure according to the invention is shown in FIG. 1. The container 1 is tamper evident. It is designed for holding and dispensing liquids such as eye drops. The container 1 is preferably flexibly deformable and preferably tube-shaped. In general the closure according to the invention can be used for many different products, in particular pharmaceutical, dental or cosmetic products, for example, eye or nose drops, ointments or toothpaste. The closure includes a spout with a twist away element and a removable cap. The closure is shown in a sealed state. In this sealed state a twist away element 3, which functions as a safety seal, is on the dispensing nozzle or spout 10, such that there is no opening. The presence of the twist away element 3 guarantees that the package hasn't been opened before or tampered with. The closure comprises a removable cap 2. In this sealed state the cap 2 prevents the twist away element 3 from breaking away accidentally. The cap 2 is preferably designed as a screw cap and held on the container 1 by a first thread 8 on the outside of the spout 2 which substantially matches with a second thread 9 on the inside of the cap 2. Alternatively it can be held by snap on means as shown in FIG. 7, i.e. rims and/or noses 16 on the outside of the container 1 or spout 10 and/or rims and/or 18 on the inside of the cap 2. The shown container 1 is designed to be closed tight again after its first opening. For such an embodiment a screw cap is preferred. A snap on cap is particularly suitable for one-time-use or one-dose containers. The cap 2 can also be attached by various combinations of thread, bayonet or snap on elements as well known to persons skilled in the art. At its container side edge the cap 2 is in contact with the shoulder of container 1. This prevents contamination of the spout 10 from the outside. Container 1 and cap 2 each have an axis, wherein these axes coincide in this closed state of the container 1.

Figure 2:
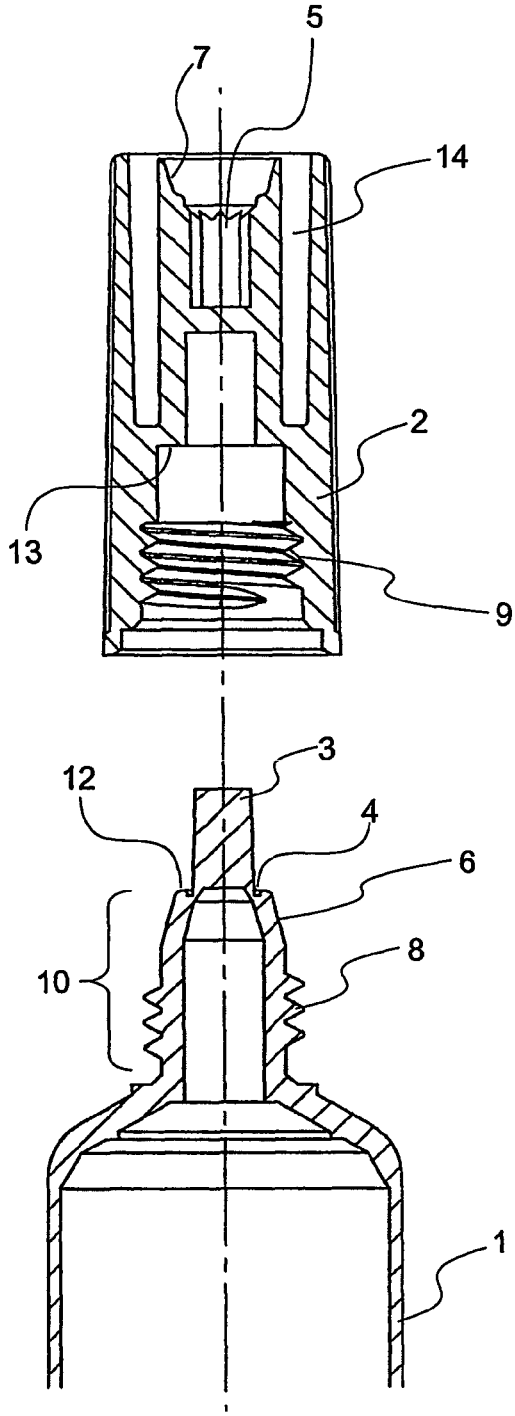

For opening the container 1 firstly the cap 2 is twisted off. FIG. 2 shows a sectional view of the same container 1 as FIG. 1, but after removal of the cap 2. The cap 2 is designed, such that it can be used as a tool for twisting away the twist away element 3, in particular along a predetermined breaking line 4. For this the cap 2 comprises a socket which is designed to fit on the twist away element 3. Socket 5 is arranged such that its symmetry axis coincides with the symmetry axis of the cap 2 The socket 5 is preferably slightly larger than the twist away element 3, such that it can be pushed on it or mated with it without exerting much force. The inner surface of the socket 5 substantially completely matches the outer surface of the twist away element 3, such that a form lock of socket and element with a good transmission of torque is possible. Alternatively only parts, certain lines or points of the surfaces may match, as long as the cap 2 can be used as a torque tool, i.e. as a wrench or socket, for twisting away the twist away element 3. The twist away element 3 is substantially a pin with a star-shaped cross-section and with an eight-fold symmetry. This multi-fold symmetry has the advantage that the socket 5 will substantially fit onto the twist away element 3 without being rotationally aligned and without twisting the twist away element 3 before the socket 5 is mated completely with the twist away element 3. Alternatively it can also be designed with a two, three, four, five or seven-fold symmetry. Preferably the distal, i.e. outer, diameter of the twist away element 3 is slightly smaller than the diameter next to its base at the predetermined breaking line 4, in order to make the process of mating it with the socket 5 easier. The twist away element 3 can also be designed shorter or even flat, i.e. that it has the form of a flat star. The cap 2 has a circular recess 14, which allows to save material and manufacturing cost and at the same time providing the cap 2 with a large outer diameter, wherein a larger outer diameter has the advantage of making the handling of the cap 2 easier. The recess is open towards the side of the socket 5 of the cap 2. For twisting off the twist away element 3 the cap 2 is inverted, i.e. rotated by 180° around an axis perpendicular to its axis, and pushed onto the spout 10. When the cap 2 is moved toward the spout 10 the cap 2 is centered by a centering aid 6, 7. The centering aid comprises a substantially conical guiding surface 6 on the spout 10 and a substantially conical guiding surface 7 inside the cap 2. Alternatively these guiding surfaces 6, 7 can also have a substantially spherical shape. The guiding surfaces 6, 7 extend the range of an eccentricity tolerance in the process of moving the cap 2 onto the spout 10, i.e. the axis of the cap 2 and the axis of spout 10 may, in the range of the elements to be mated, be initially up to several millimeters apart but the socket 5 and the twist away element 3 will still align while the cap 2 is pushed towards and onto the spout 10. This has the advantage that removing the safety seal when opening the container 1 for the first time does not require good, cognitive or motoric skills. The first guiding surface 6 is formed on the outer surface of the spout 10 between a rim 12 at the distal end of the spout 10 and the thread 8 of the spout 10. The second guiding surface 7 is formed on an inner surface of the cap 2, substantially beginning at the distal end of the cap 2 running inward, such that the wrench or socket 5 is an inward continuation of said second guiding surface 7.

Figure 3:
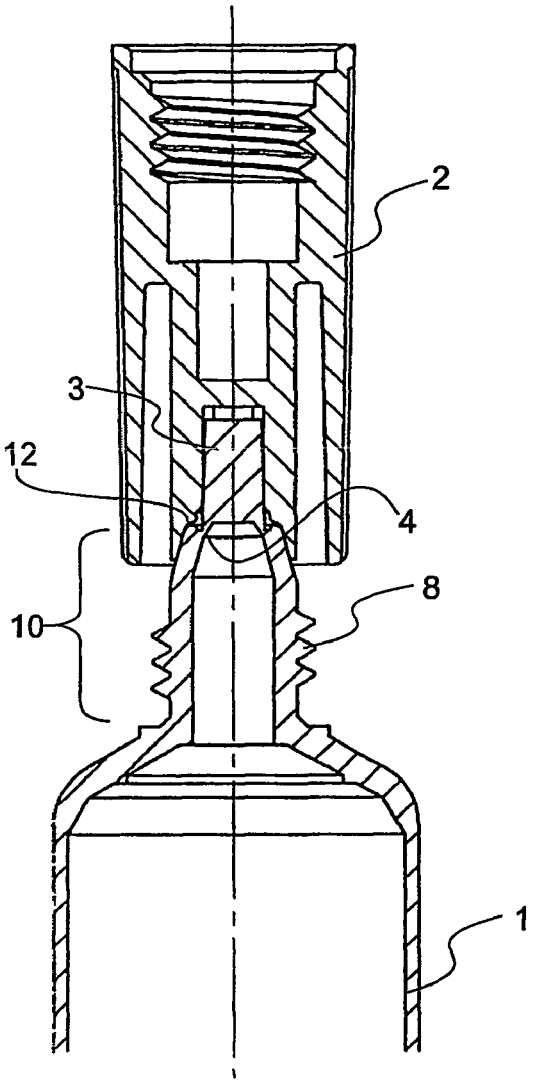

The inverted cap 2 on the spout 10 is shown in a sectional view in FIG. 3. The first guiding surface 6 rotatably mates with the second guiding surface 7 as long as the cap 2 is pushed completely with the wrench or socket 5 first onto the spout 10. This has the advantage that the cap 2 can only be turned, but not be broken away, which assures a complete and accurate removal of the twist away element 3. When the cap 2 is turned around its axis the twist away element 3 breaks from the spout 10 along a predetermined breaking line 4. The predetermined breaking line 4 has the shape of a circle. Along this circle the thickness of the wall of the spout 10 is much smaller that at adjacent areas. Preferably the predetermined breaking line 4 is below the rim 12 of the spout 10, such that the breakage surface, i.e. the areas of the predetermined breaking line 4 after removal of the twist away element 4, are not exposed to the object, surface or part of the body to which the contents of the container 1 are applied. For example in case of eye drops the possibly harmful breakage surface cannot get in contact with the eye. The rim 12 is on the distal, i.e. outer, end of the spout 10. The predetermined breaking line 4 is arranged countersunk in respect to said rim 12. It is therefore substantially inside the spout 10.

Figure 4:
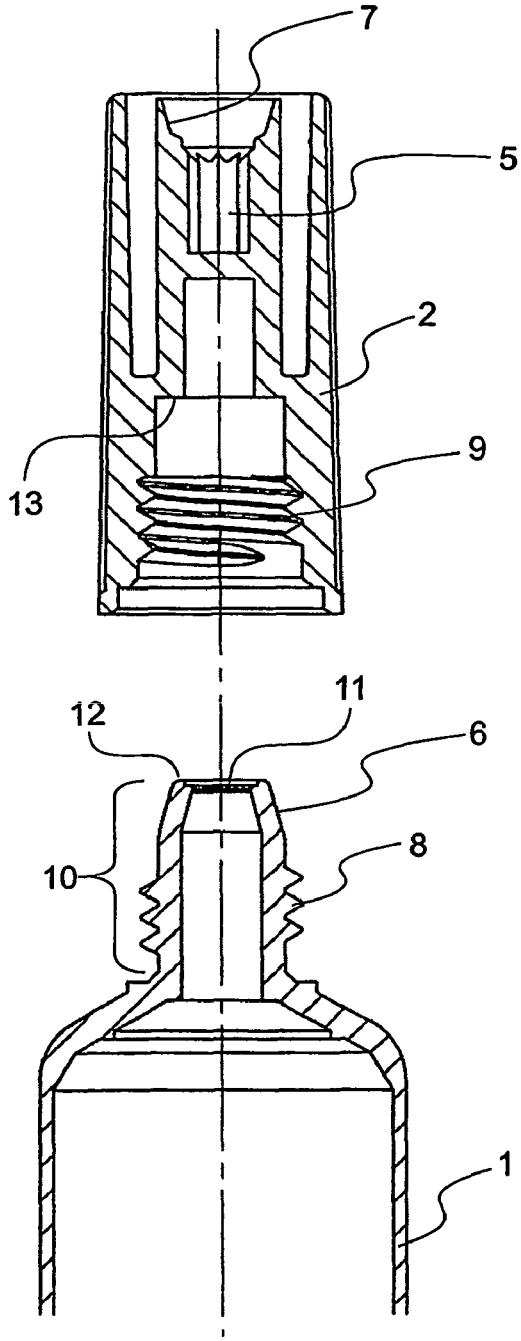

FIG. 4 is a sectional view of the container 1 of FIG. 1 to 3 after the twist away element was removed. The content of the container 1 can now be dispensed through the opening 11 in the spout 10. The opening 11 has a circular shape, corresponding to the circular shape of the predetermined breaking line before removal of the twist away element. The spout 10 may also contain a throttling device, such that the spout 10 can be used for controllably dispensing drops, in particular eye drops. The cap 2 can be used to close the opening 11 on the spout 10. When the cap 2 is twisted onto the spout 10, rim 12 of the spout 10 mates with rim 13 of the cap 2, such that the closure is tight. In the preferred embodiment rim 12 of the spout 10 is also the distal end of spout 10. Alternatively the distal rim and the rim to mate with a rim 13 of the cap 2 may be embodied separated. This is advantageous if the distal rim has a certain design, for example for dispensing drops, which is not suitable for integrating a sealing surface or which would be impaired by the force applied when the cap 2 is twisted or pushed onto the container 1.

Figure 5:
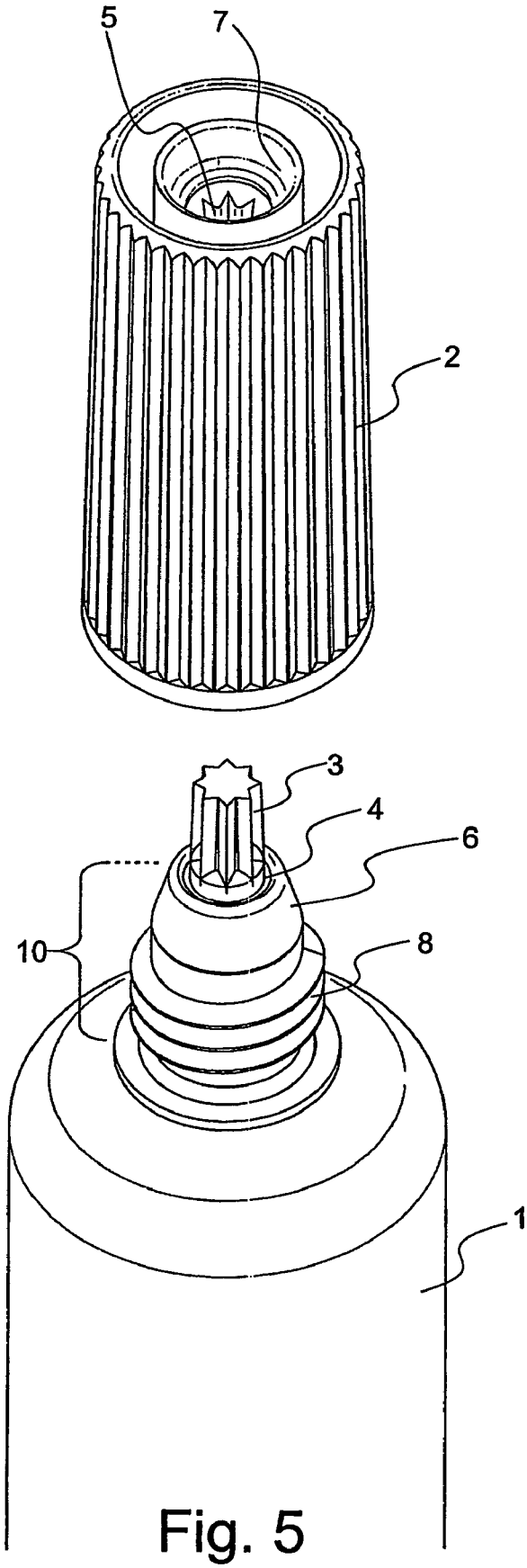

FIG. 5 shows a three dimensional view of a container 1 with a preferred embodiment of the closure according to the invention. The closure comprises a spout 10 and a cap 2. The cap 2 is corrugated lengthwise on its outside surface, such that it can be turned easier when being used as a tool for removing the twist away element 3 or as a screw cap for the spout 10. The cap 2 can be made using an injection moulding process. The container 1 has preferably a tube-shape, is flexibly deformable and preferably comprises a multi-layer laminate, in particular with an aluminium or plastic barrier.

Figure 6:
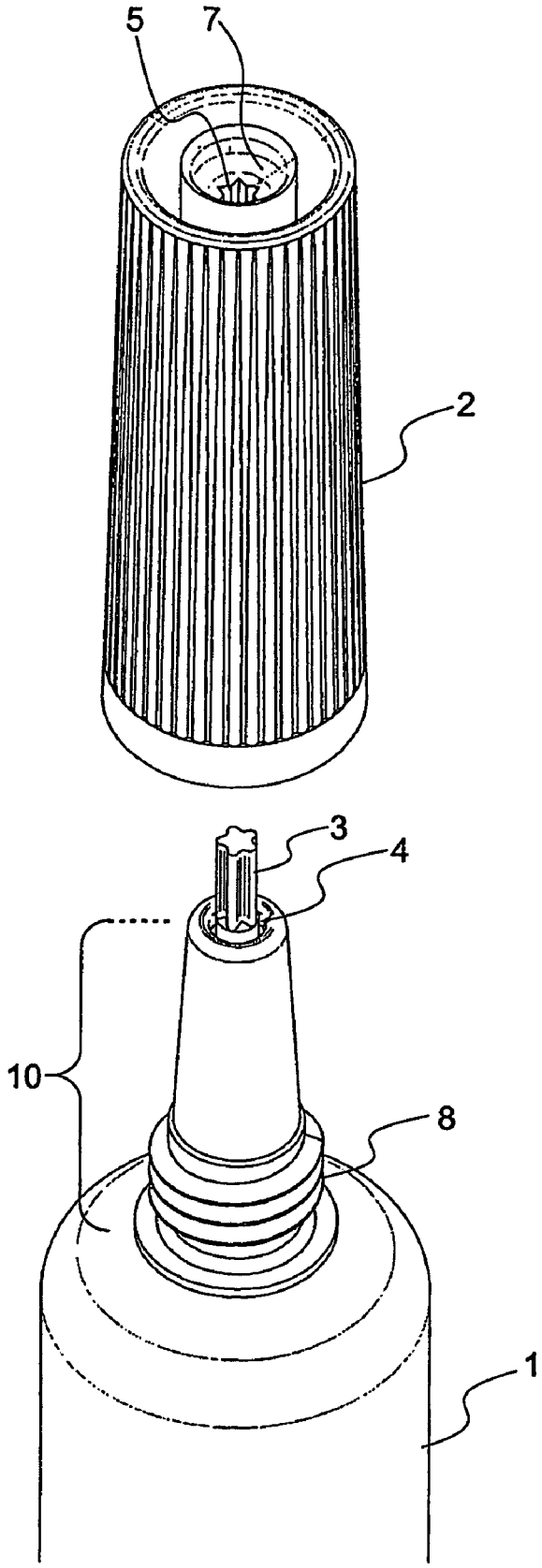

FIG. 6 shows a three dimensional view of a container 1 with a further preferred embodiment of the closure according to the invention. In this embodiment the spout 10 is designed especially long, as a cannula, in order to allow a locally more precise dispensing.

The invention claimed is:

1. A tamper evident closure for containers, wherein the closure comprises a spout with a twist away element and a removable cap, wherein the cap comprises a wrench or a socket, such that the cap can be used as a tool for twisting away said twist away element and thereby creating a opening in the spout, wherein the wrench or socket is, while the spout is closed by the cap, on a side of the cap opposite the spout, such that the cap is to be inverted when being used as a tool for twisting away the twist away element, wherein the closure comprises a centering-aid, which centers the cap while it is moved, with the wrench or socket first, towards and onto the spout, characterized in that the centering-aid comprises a first guiding surface on the spout and a second guiding surface on an inner surface of the cap and inwardly extending into the cap such that the wrench or socket is an inward continuation of the second guiding surface, wherein the first guiding surface rotatably mates with the second guiding surface, once the cap is pushed completely with the wrench or socket first onto the spout.

2. The closure according to claim 1 wherein the first guiding surface and the second guiding surface are substantially conic.

3. The closure according to claim 1 wherein the first guiding surface is formed on an outer surface of the spout between a rim at a distal end of the spout and the container.

4. The closure according to claim 1 wherein the twist away element has the form of a pin or a star.

5. The closure according to claim 1 wherein the wrench or socket matches at least at some points the form of the twist away element, such that transmission of a torque is possible.

6. The closure according to claim 1 wherein the spout comprises a first thread and the cap comprises a second thread, wherein the first thread and the second thread are designed to match each other, and the first thread is an outside thread and the second thread is an inside thread.

7. The closure according to claim 1 wherein the outer diameter of the cap is substantially larger than the diameter of the spout and the wrench or socket, wherein the cap has a circular recess around the socket.

8. The closure according to claim 1 wherein the spout is designed as cannula.

9. The closure according to claim 1 comprising a predetermined breaking line between the spout and the twist away element, which predetermined breaking line is arranged substantially inside the spout or countersunk in respect to a rim at the distal end of the spout.

10. The container, comprising a closure according to claim 1.

11. The closure according to claim 1, wherein a symmetry axis of the socket coincides with a symmetry axis of the cap.

12. The closure according to claim 1, wherein the first guiding surface and the second guiding surface are substantially spherical.

13. The closure according to claim 1, wherein the second guiding surface is formed on an inner surface of the cap such that the socket is an inward continuation of said second guiding surface.

14. The closure according to claim 1, wherein the twist away element has a multi-fold symmetry.

15. The closure according to claim 14, wherein the twist away element has a three-fold, four-fold, five-fold, six-fold, seven-fold or eight-fold symmetry.

16. The closure of claim 7, wherein the circular recess is open toward the same side as the socket.

17. A tube comprising the closure of claim 1.

* * * * *